United States Patent [19]

Byrd, Jr.

[11] 4,086,737

[45] May 2, 1978

[54] REFRACTORY FIBER BLANKET MODULE WITH HEAT SHRINKAGE COMPENSATION

[75] Inventor: Carlisle O. Byrd, Jr., Houston, Tex.

[73] Assignee: Johns-Manville Corporation, Denver, Colo.

[21] Appl. No.: 757,772

[22] Filed: Jan. 7, 1977

[51] Int. Cl.[2] ..... E04C 3/10; E04B 1/80

[52] U.S. Cl. ..... 52/227; 52/232; 52/404; 52/506; 52/596; 52/598; 52/747; 156/71; 156/93; 156/94; 264/30; 428/99; 428/102; 428/234; 428/285; 428/920

[58] Field of Search ..... 428/102, 234, 284, 285, 428/920, 99; 52/227, 747, 232, 404, 406, 596, 598, 622, 506; 110/1 A, 1 B; 266/281, 283, 285; 264/30; 156/93, 94, 71

[56] References Cited

U.S. PATENT DOCUMENTS

| | | | |
|---|---|---|---|
| 1,252,415 | 1/1918 | Duckham | 52/232 |
| 3,248,257 | 4/1966 | Cadotte et al. | 52/612 X |
| 3,523,395 | 8/1970 | Rutter et al. | 52/506 X |
| 3,553,920 | 1/1971 | Cole, Jr. | 52/506 |
| 3,605,370 | 9/1971 | Prible | 52/513 X |
| 3,819,468 | 6/1974 | Sauder et al. | 428/99 |
| 3,832,815 | 9/1974 | Balaz et al. | 52/506 X |
| 3,930,916 | 1/1976 | Shelby | 52/506 X |
| 4,001,996 | 1/1977 | Byrd, Jr. | 52/509 |

*Primary Examiner*—Alfred C. Perham
*Attorney, Agent, or Firm*—Robert M. Krone; Joseph J. Kelly; James W. McClain

[57] ABSTRACT

A refractory fiber blanket furnace lining module with compensation for heat shrinkage, and method of assembly of such a module, are disclosed. In the module as assembled, the refractory fiber material is in compression in horizontal planes coplanar with the hot face and also in compression in planes vertical to the hot face. Upon or after installation, the horizontal compression is removed so that the fibers may expand to compensate for heat shrinkage as such shrinkage occurs and maintain a seal in joints between adjacent modules.

21 Claims, 4 Drawing Figures

REFRACTORY FIBER BLANKET MODULE WITH HEAT SHRINKAGE COMPENSATION

CROSS-REFERENCE TO RELATED APPLICATIONS

This application relates to modular refractory fiber blanket furnace lining systems, as does copending U.S. patent application Ser. No. 603,391, filed Aug. 11, 1975, which in turn is a continuation-in-part of U.S. patent application Ser. No. 475,439, now U.S. Pat. No. 3,952,470. Other continuations-in-part of these parent applications are U.S. patent applications Ser. Nos. 757,749, 775,750, 757,748, now U.S. Pat. No. 4,055,926 filed of even date herewith.

BACKGROUND OF THE INVENTION

1. Field of Invention

The present invention relates to modular refractory fiber blanket furnace lining systems.

2. Description of Prior Art

Refractory fiber blankets made from refractory materials such as chromia-alumina-silica, alumina-silica compositions and zirconia compositions have become desirable as furnace insulation because of their ability to withstand high temperatures. The fiber blanket material has been attached in a layered construction arrangement to the furnace wall using attachment structure, as exemplified in U.S. Pat. Nos. 3,523,395 and 3,605,370. Another technique is to fabricate the refractory fiber blankets into modules, as in U.S. Pat. Nos. 3,819,468 and 3,832,815.

With these refractory fiber blanket modules, heat shrinkage of the ceramic fibers during service along those faces of the modules closest to interior conditions in the furnace, known as the "hot face," could cause cracks or fissures and form paths for undesirable heat flow from the interior of the furnace torwards the wall of the furnace.

One approach has been to arrange the modules in a parquet-like construction, as shown in these U.S. Pat. Nos. 3,819,468 and 3,832,815. In U.S. Pat. No. 3,832,815, the individual modules were formed from trapezoidal configuration individual blanket strips which were thicker at the hot face than adjacent the surface to be mounted with the furnace wall. This configuration was intended to exert compressional forces between adjacent modules once installed in the parquet-like configuration and compensate for shrinkage of the fibers. However, cutting blanket strips to this trapezoidal configuration caused difficulties.

Additionally, in both U.S. Pat. No. 3,819,468 and 3,832,815 the blanket strips were attached by being speared at one end, near the cold face thereof, and suspended therefrom. Often during service use, the suspended blanket might slip or come loose due to being mounted in this manner. Further, so far as is known, when so installed, the general orientation of fibers in the blankets was in the direction of heat flow from the hot face to the cold face. This type of fiber orientation did not permit use of optimum insulation characteristics of the blanket, which occurs when the fibers are generally oriented transversely to the direction of heat flow.

SUMMARY OF THE INVENTION

Briefly, the present invention relates to a new and improved refractory fiber blanket module for insulating a wall or roof area of a furnace or like equipment with heat shrinkage compensation, and a method of manufacture of such a module. A plurality of layers of refractory fiber blanket, at least some of which are larger in areal extent than the area to be lined, are arranged in a group substantially parallel to the furnace wall. A horizontal compressive force in a plane parallel with the plurality of layers is then imparted to those larger area layers to reduce their area to substantially the area to be lined. Structure is also included to attach the layers with the area to be lined. When the blocks are installed, the horizontal force is removed, while the compressed larger area layers remain in contact with similarly compressed layers on adjacent blocks so that these layers are urged against each other to provide a buffer which compensates for heat shrinkage and provides for reduced likelihood of cracks or furrows between adjacent modules due to heat shrinkage. The fiber layers of the blocks are also subjected to a vertical force along the general direction of heat flow therethrough to increase the density of the module and consequently the insulation capacity thereof. This vertical force is retained on the fiber layers during service use.

DESCRIPTION OF THE PREFERRED EMBODIMENT

Figure 1:
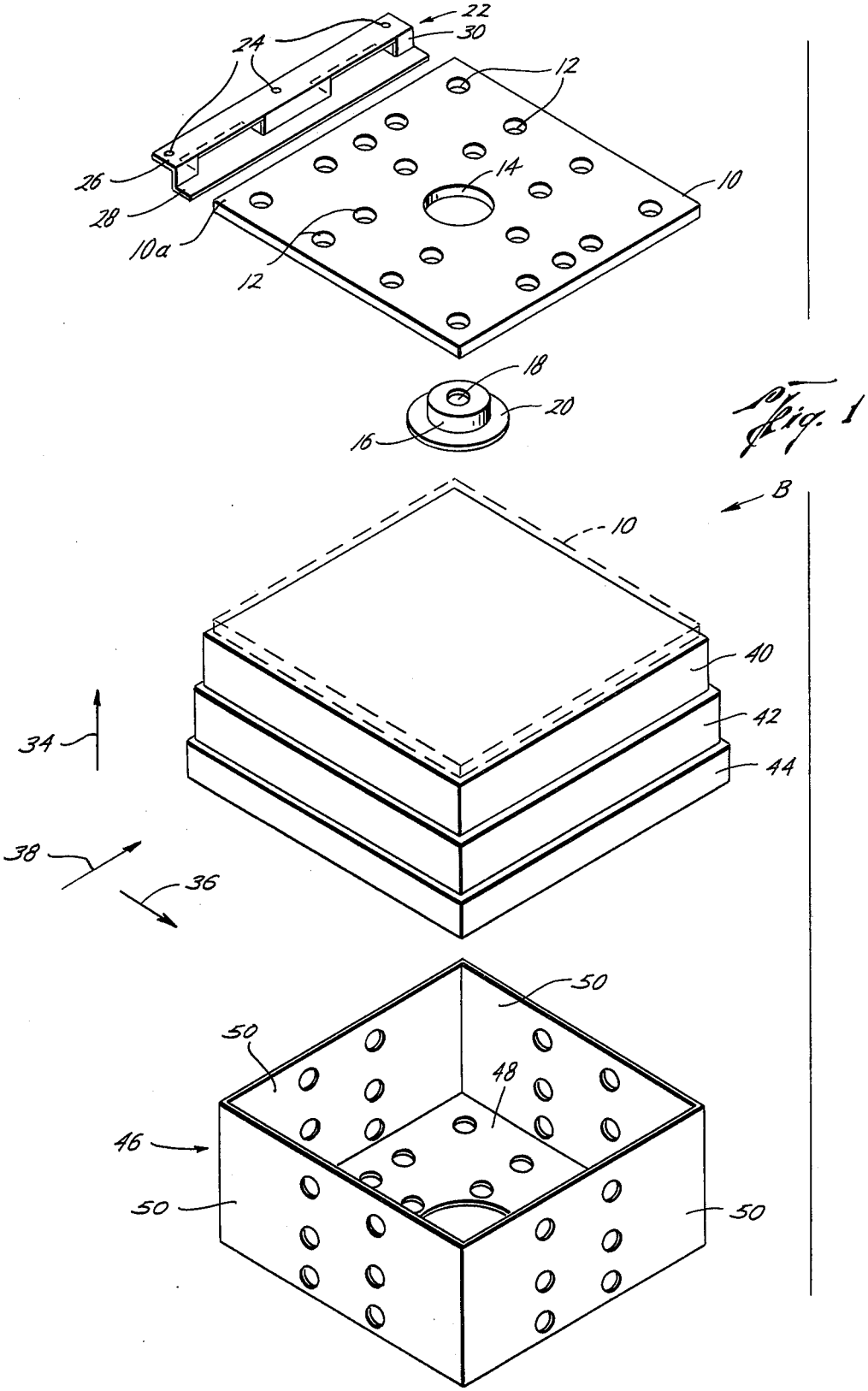
FIG. 1 is an exploded isometric view of a fiber blanket module according to the present invention.

In the drawings, the letter B designates generally an insulating block or module of the present invention for lining an area of a wall (not shown), which may be either the side wall or a roof of a furnace or some other high temperature equipment such as soaking pits, annealing furnaces, stress relieving units and the like. The insulating block B is formed, in a manner to be set forth below, from refractory fiber insulating blankets for insulating the furnace, and an attachment mounting for mounting the blanket B to the wall. Considering the blanket material more in detail, such blanket is formed from a suitable commercially available refractory ceramic fiber blanket, such as the type known as "Cerablanket," sold by the Johns-Manville Company, containing alumina-silica fibers or other suitable commercially available refractory fibrous materials. It should be understood that the particular component materials of the refractory fiber blanket used in the blankets B are selected based upon the range of temperatures in the high temperature equipment in which the block B is to be installed.

The block B is adapted to line a certain areal extent of the furnace wall or roof being lined, which is coextensive in area with the surface area of a generally square or rectangular inner panel 10 of ceramic fiber insulating board or panel material. The inner panel 10 has a number of small perforations or holes 12 formed therein, for reasons to be set forth. The holes 12 have been greatly enlarged in size so that they may be seen in the drawings. Further, due to this increase in size, a considerable number of such holes are not shown in the drawings. A large centrally located opening or passage 14, shown approximately to scale, is formed in panel 10 for receiving an attachment disc or washer 16 to attach the block B to the wall of the equipment being lined.

The washer 16 has a central opening 18 for receipt therein of a suitable attaching nail, nut, bolt or screw to attach the block B by any suitable attaching method to the wall area of the equipment being lined. The disc 16 further has an enlarged lower rim or flange 20 spaced inwardly from the portion of the disc 16 having the opening 18. The flange 20 is greater in area than the opening 14 of the panel 10 in order to retain such panel in place once installed.

A channel connector member 22, having suitable opening 24 formed in a mounting strip member 26 for receipt therein of suitable attaching means of the type set forth above, further serves as a component of the attachment mounting. The connector member 22 is adapted to be mounted along an edge 10*a* of the panel 10 and interconnect adjacent blocks B as they are installed. The connector member 22 has an inner rearwardly extending ledge or shelf member 28 adapted to be inserted beneath the edge 10*a* of panel 10 (FIGS. 3 and 4) and along with the washer 16 retain the block B on the wall being lined. Portions of an intermediate connector leg 30 are punched forward to form an inwardly extending forward ledges or shelves 32 (FIGS. 3 and 4) which is adapted to be inserted beneath the panel 10 of the next adjacent block B and retain such panel therein in the pocket formed between the shelves 32 and the strip member 26.

The insulating material of the block B is in the form of a plurality of layers of refractory fiber blanket as set forth above. Preferably, these layers are formed by being cut from strips of refractory fiber blankets so that the fibers thereof extend in planes generally parallel to the wall of the equipment being lined, and generally transverse to the direction of heat flow therethrough. An arrow 34 designates generally the direction of heat flow therethrough, while arrows 36 and 38 represent typical directions of extent of the planes of the fibers.

Further, according to the present invention, at least certain layers of the refractory fiber blankets in the block B are larger in areal extent that the area of the furnace wall being lined when the block B is originally being formed. For example, an inner layer 40 next adjacent to panel 10 has a slightly larger areal extent over both length and breadth dimensions thereof as is evidenced from inspection of such layer with the phantom outline thereabove of panel 10 (FIG. 1). It is also preferable, for reasons to be set forth, that each next innermost layer be somewhat larger in areal extent, both in length and width, than the preceding layer. For example, the next innermost fiber blanket layer 42 is somewhat larger in areal extent than the layer 40 over both length and width dimensions. Also, an innermost layer 44 of the block B, most close to the hot face, or innermost conditions in the furnace, is again slightly larger in areal extent than the intermediate blanket layer 42.

The block B is assembled by placing the blanket layers 40, 42 and 44 with the largest area lowermost within a container or box 46, which may be in the form of a plastic box or the like of suitable rigidity to retain the blankets therein in block form. The box 46 has a lower surface 48 with an area equal to the area of the furnace being lined. Further, the box 46 has side walls 50 extending vertically upwardly from the lower surface 48. The lower surface 48 and the side walls 50 have a number of small perforations or holes 52 formed therein, which are enlarged so that they may be seen in the drawings, as was the case with the holes 12 in panel 10. The lower surface 48 has an enlarged center opening 54, shown approximately to scale, through which a knife or cutting tool may be inserted to make a small passageway through the blanket layers 40, 42 and 44 for a suitable attaching tool so that the disc 16 may be attached to the wall area of the furnace being lined.

Figure 2:
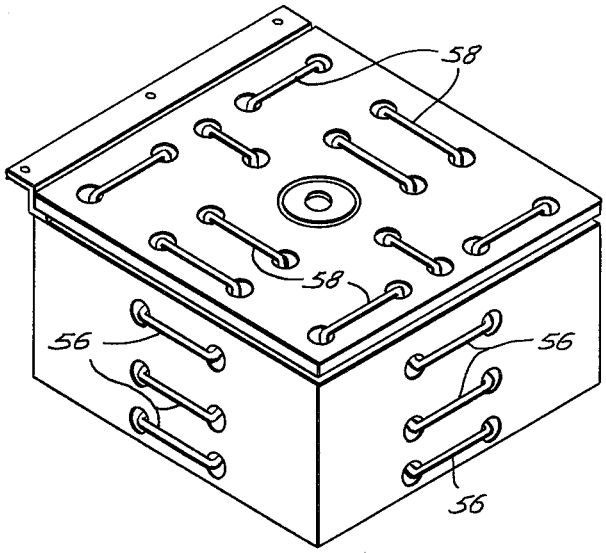
FIG. 2 is an isometric view of the module of FIG. 1 in assembled form.

According to the present invention, the layers 40, 42 and 44 are subjected to a compressive force after being inserted into the box 46. This compressive force is imparted partially by the box 46 itself, and further by passing horizontally through such layers, in a plane substantially parallel to the plane of the layers and the furnace wall, such as the plane of arrows 36 and 38, a suitable thread or string 56. This thread or string is repeatedly inserted through the openings or perforations 52 in the side walls 58 of the container 46 and binds and restrains the fibers in a manner so as to impart thereto a horizontal compressive force. Such a thread is shown in exaggerated size in FIG. 2 so that it may be clearly seen and schematically in phantom in FIG. 3. It is preferable that the thread or string 56, as well as the container 46, be formed from a heat consumable material, for reasons to be set forth.

Further, a vertical compressive force, in a plane parallel to the heat flow through the block B (as shown by arrow 34) and transverse to the hot face of such block is imparted to the refractory fiber blanket layers of the block B. A thread 58 is sewn through the openings 12 in the panel 10, the layers in the box 46 and the openings 54 in the lower surface 48 thereof by repeated insertions through the various perforations 14 in the panel 10 and the perforations 54 in the lower surface 48 of the box. As with thread 56, the thread 58 is shown in enlarged size in FIG. 2 so that it may be clearly seen, and schematically in FIGS. 3 and 4. Care is, however, to be taken during sewing of thread 58 so that no such threads are in the blanket in the area adjacent the opening 54. This is done to prevent possible damage to the threads 58 resulting from insertion of the attaching tool into the block B in this area.

With the present invention, it has been found desirable to retain this imparted vertical force throughout service usage of the block B. Thus, the thread 58 is preferably formed of a heat resistant material, of the type suitable to withstand hot face temperatures. A suitable material for the thread is, for example, the type of continuous filament metal oxide thread, such as that sold by 3M Company of St. Paul, Minn., designated Ceramic Fiber AB-312. This thread is a continuous filament of alumina-boria-silica composition, further details of which are set forth in *Design News* magazine in the May 10, 1976 issue. These threads are there stated to withstand continuous usage temperatures of 2600° F.

By imparting a vertical compressive force to the layers of the blanket B in this manner, the density of the blanket B is increased, thereby increasing the insulation characteristics thereof. Further, by using continuous filament metal oxide threads of the type set forth layers throughout the blanket B, including those at or adjacent to the hot face, may be subjected to the vertical compressive force and have the insulation capacity thereof increased.

Furthermore, with the present invention, it has been found desirable to permit the imparted horizontal compressive force the string 56 to be released, permitting the compressed fibers of the layers of blanket in the block B to expand and fill any cracks or fissures should any heat shrinkage occur during service usage of the block B. In this manner, heat shrinkage compensation is permitted to occur and accordingly provide a substantially reduced likelihood of fissures or cracks between adjacent blocks B once installed. Preferably according to the present invention, the box 46 and the thread 56 are formed from a heat dissoluable material, such as a suitable plastic or synthetic resin. The thread 56, must of course, be capable of withstanding the stress of the compressional forces imparted to the block B.

The blocks B, after being fabricated in the manner set forth above, are then installed in transverse rows across the wall or roof of the equipment to be insulated. As each transverse row of blocks B is installed by being attached to the wall, the channel member 22 of the attachment mounting structure M is then installed at the edge 10*a* of such blocks and the channel member 22 is attached to the wall of the equipment.

Figure 3:
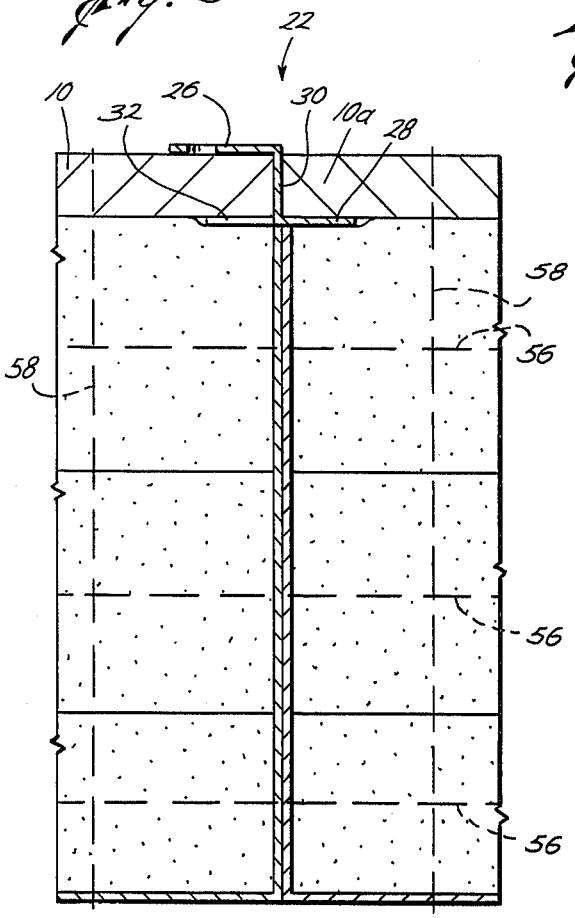
FIGS. 3 and 4 are cross-sectional views of modules of the present invention as installed and after service use, respectively.
Figure 4:
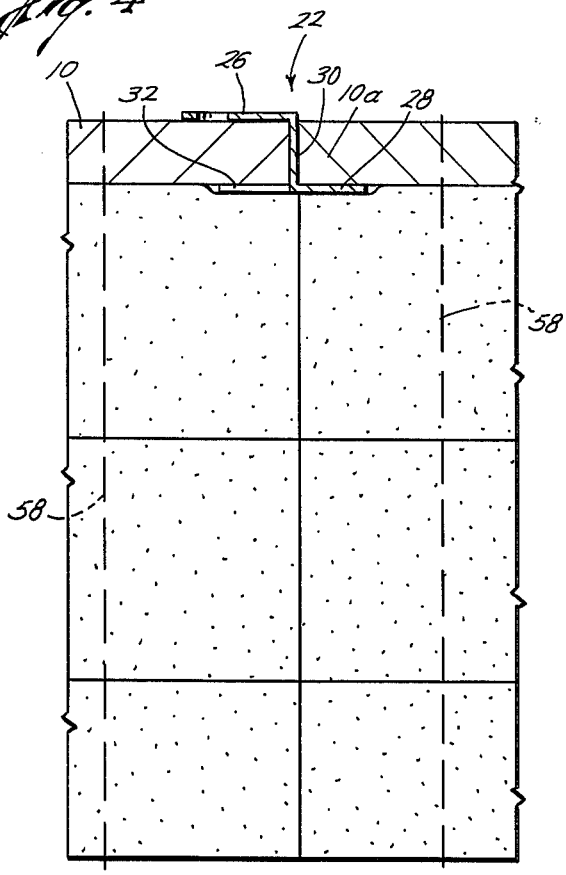

The panel 10 of the next succeeding block B of the next transverse row is then installed by inserting the panel 10 thereof into the pocket formed by shelves 32 and attaching strip member 26 of the channel member 22, and such block is then welded or attached to the wall of the furnace by the disc 16. After the wall of the furnace has been lined with blocks B in this manner, but prior to igniting the furnace, the threads 56 and 58 are arranged in blocks B as shown in FIG. 3.

However, as the furnace temperature increases during heating up of the furnace, the box 46 and the threads 56 are consumed by the heat. When the box 46 and threads 56 are so consumed (FIG. 4), the imparted horizontal compressive force on the fiber blanket layers of the blanket B is removed, causing such layers to expand and fill the gap left by dissolved box 46, forcing such layers into firm engagement (FIG. 4) with adjacent layers of similar blocks B and exerting compressive forces therebetween. The compressive force between adjacent blocks compensates for possible heat shrinkage during service use of the blocks B.

Although it is preferable that each of the layers of the block B be of increasingly greater areal extent inwardly from the cold face of the block to the hot face, those most adjacent the cold face or furnace wall could be of equal area to the plate 10 if desired. Also, one or more of the intermediate layers of the refractory fiber block B might be formed from bulk ceramic fiber and have vertical and horizontal compressive forces applied to in a like manner to the refractory fiber layers as set forth above. Further, the threads 56 imparting the horizontal compressive force on the block B might be cut during installation, if desired, rather than relying on heat consumption thereof.

Further, if desired, the block B may have continuous fiber metal oxide cloth attached thereto, as set forth in copending U.S. patent application Ser. No. 757,749 to prevent erosion of the fibers.

The foregoing disclosure and description of the invention are illustrative and explanatory thereof, and various changes in the size, shape and materials as well as in the details of the illustrated construction may be made without departing from the spirit of the invention.

I claim:

1. An insulating block for lining a wall or roof area of a furnace or like equipment, comprising:

(a) a plurality of layers of refractory fiber blanket adapted for mounting to the furnace wall in substantially parallel relation therewith;

(b) at least one of said layers being larger in areal extent than the area to be lined;

(c) force-exerting means, removable after said block is installed in said furnace, for imparting a horizontal compressive force in a plane parallel with said plurality of layers on said at least one of said layers to reduce the areal extent of same to substantially the area to be lined; and (d) means for attaching said plurality of layers to the area to be lined.

2. The structure of claim 1, wherein said block is mounted with a cold face attached to the equipment and extends therefrom to a hot face exposed to furnace conditions, and wherein:

(a) each of said plurality of layers is larger in areal extent than the area to be lined; and (b) said force-exerting means comprises means for imparting a horizontal compressive force in a plane parallel with said plurality of layers on each of said layers to reduce the areal extent of same to substantially the area to be lined.

3. The structure of claim 1, wherein said plurality of layers comprise at least an inner layer closest to the furnace wall and an outer layer adjacent the hot face in the furnace, and further including:

each of said plurality of layers is larger in areal extent than layers closer to the furnace wall.

4. The structure of claim 1, wherein said plurality of layers comprise at least an inner and an outer layer, and further including:

at least one layer of bulk ceramic fiber mounted between said inner and outer layers.

5. The structure of claim 1, wherein said plurality of layers comprise at least an inner and an outer layer, and further including:

said layers of refractory fiber blanket contain refractory fibers therein extending generally in planes substantially transverse to heat flow from the hot face to the cold face.

6. The structure of claim 1, further including:

means for imparting a vertical compressive force transverse the plane of the wall or roof area to said plurality of layers.

7. The structure of claim 6, wherein said means for imparting a vertical compressive force comprises:

continuous filament metal oxide thread extending through said plurality of layers and imparting a compressive force thereon.

8. The structure of claim 1, wherein said force-exerting means comprises:

a heat dissoluble thread which is consumed during service usage of the block when installed.

9. The structure of claim 1, wherein said force-exerting means comprises:

a container for receiving said plurality of layers therein, said container having a surface area adjacent the hot face substantially equal in areal extent to the area being lined.

10. The structure of claim 9, wherein:

said container is formed from a heat dissoluble material which is consumed during service usage of the block when installed.

11. The structure of claim 9, wherein:

(a) said container includes openings formed therein on side portions thereof away from the hot face and cold face; and further including (b) thread passing through said openings and said layers in said container to assist in imparting a horizontal compressive force thereon.

12. The structure of claim 1, wherein said block is mounted to a cold face area of the equipment and further including:

a ceramic fiber insulating board mounted by said means for attaching said plurality of layers of blanket to the equipment.

13. The structure of claim 12, further including:

means for attaching said plurality of layers to said insulating board.

14. A method of fabricating refractory fiber insulating blocks for lining a wall or roof area of a furnace or like equipment, comprising the steps of:

(a) assembling a plurality of layers of refractory fiber blanket in a laminar arrangement of substantially parallel layers, at least one of said layers being larger in areal extent than the area to be lined;

(b) imparting a horizontal compressive force in a plane parallel with said plurality of layers to said at least one of said layers to reduce the area thereof to substantially the area to be lined, said imparting being by means of a force-exerting means which is removable after said block is installed in said furnace; and (c) mounting with said plurality of layers attachment structure by which said plurality of layers may be attached to the area being lined.

15. The method of claim 14, wherein each of said layers is larger in areal extent than the area being lined and wherein said step of imparting comprises the step of:

imparting a horizontal compressive force in a plane parallel with said plurality of layers to each of said layers to reduce the area thereof to substantially the area to be lined.

16. The method of claim 14, wherein said plurality of layers comprise at least an inner and an outer layer, and further including the step of:

mounting a layer of bulk ceramic fiber between said inner and outer layers.

17. The method of claim 14, further including the step of:

imparting a compressive force transverse the plane of the wall of roof area to said plurality of layers.

18. The method of claim 14, wherein said step of imparting a horizontal compressive force comprises the step of:

inserting binding members through said plurality of layers to exert the horizontal compressive force thereon.

19. The method of claim 14, wherein said step of imparting a horizontal compressive force comprises the step of:

inserting said plurality of layers into a container having a surface area adjacent the hot face substantially equal in areal extent to the area being lined.

20. The method of claim 19, wherein the container has openings on sides thereof transverse the hot face and the cold face and wherein said step of imparting further comprises:

inserting binding members through the openings in the container and through said plurality of layers to exert the horizontal compressive force thereon.

21. An insulating block for lining a wall or roof area of a furnace or like equipment, comprising:

(a) a plurality of layers of refractory fiber blanket adapted for mounting with the furnace wall in substantially parallel relation therewith;

(b) said layers of refractory fiber blanket contain refractory fibers therein extending generally in planes substantially transverse to heat flow;

(c) means for imparting a vertical compressive force transverse the plane of the wall or roof area to said plurality of layers;

(d) means for attaching said plurality of layers to the area to be lined;

(e) at least one of said layers being larger in areal extent that the area to be lined; and (f) means for imparting a horizontal compressive force in a plane parallel with said plurality of layers on said at least one of said layers to reduce the areal extent of same to substantially the area to be lined, said means being removable after said block is installed in said furnace.

* * * * *